US008079770B2

(12) United States Patent
Widmer et al.

(10) Patent No.: US 8,079,770 B2
(45) Date of Patent: Dec. 20, 2011

(54) CLEANING TOOL WITH FLUID DELIVERY DEVICE

(75) Inventors: Fredi D. Widmer, Wil (CH); Axel Schmitz, Gommiswald (CH)

(73) Assignee: Diversey, Inc., Sturtevant, WI (US)

( * ) Notice: Subject to any disclaimer, the term of this patent is extended or adjusted under 35 U.S.C. 154(b) by 250 days.

(21) Appl. No.: 12/446,616

(22) PCT Filed: Oct. 24, 2007

(86) PCT No.: PCT/US2007/082399
§ 371 (c)(1),
(2), (4) Date: Apr. 22, 2009

(87) PCT Pub. No.: WO2008/052063
PCT Pub. Date: May 2, 2008

(65) Prior Publication Data

US 2009/0269125 A1 Oct. 29, 2009

Related U.S. Application Data

(60) Provisional application No. 60/863,017, filed on Oct. 26, 2006.

(51) Int. Cl.
*A47L 1/08* (2006.01)

(52) U.S. Cl. ..... 401/138; 401/137; 401/139

(58) Field of Classification Search ..... 401/137–140, 401/27, 38, 34, 39, 195, 270, 263, 205, 47, 401/36, 44, 46; 15/228; 222/191, 192
See application file for complete search history.

(56) References Cited

U.S. PATENT DOCUMENTS

| | | | | |
|---|---|---|---|---|
| 2,003,847 | A * | 6/1935 | Woods | 401/34 |
| 3,028,615 | A * | 4/1962 | Helm | 15/50.1 |
| 3,081,481 | A * | 3/1963 | Nohl et al. | 401/138 |
| 5,601,211 | A * | 2/1997 | Foster | 222/383.1 |
| 5,782,991 | A | 7/1998 | Van Der Heyden et al. | |

(Continued)

FOREIGN PATENT DOCUMENTS

JP 2006-312022 11/2006

(Continued)

OTHER PUBLICATIONS

The International Search Report prepared by the Korean Intellectual Property Office.

(Continued)

*Primary Examiner* — David Walczak
*Assistant Examiner* — Jennifer C Chiang
(74) *Attorney, Agent, or Firm* — Gregory S. Bollis

(57) ABSTRACT

A fluid delivery system for a cleaning tool. In one embodiment, the fluid delivery system includes a reservoir, a first conduit and a second conduit coupled to the reservoir and adapted to selectively dispense fluid from the reservoir, wherein an end of the second conduit is moveable relative to the first conduit to dispense fluid in a plurality of directions. In another embodiment, the fluid delivery system includes a reservoir adapted to contain at least one fluid, a first conduit coupled to the reservoir adapted to selectively dispense fluid from the reservoir, and a second conduit coupled to the reservoir adapted to selectively dispense fluid from the reservoir independent of the first conduit. In another embodiment, the fluid delivery system has a reservoir with a first and second outlet wherein the second outlet selectively dispenses fluid from the reservoir independent of the first outlet.

11 Claims, 2 Drawing Sheets

U.S. PATENT DOCUMENTS

| | | | | |
|---|---|---|---|---|
| 5,983,448 | A | 11/1999 | Wright et al. | |
| 6,394,683 | B1 | 5/2002 | Pao | |
| 6,726,388 | B1 | 4/2004 | Monahan | |
| 6,945,438 | B1 * | 9/2005 | Shih et al. | 222/608 |
| 7,004,663 | B1 | 2/2006 | Cupidon-Ebanks | |
| 7,194,782 | B1 * | 3/2007 | Lewis | 15/321 |
| 7,581,662 | B2 * | 9/2009 | Powell | 222/401 |
| 7,618,206 | B2 * | 11/2009 | Sacks | 401/138 |
| 7,717,354 | B1 * | 5/2010 | Robinson | 239/1 |
| 7,891,036 | B2 * | 2/2011 | Hahn et al. | 15/50.3 |
| 2004/0047670 | A1 | 3/2004 | Martin | |

FOREIGN PATENT DOCUMENTS

| | | |
|---|---|---|
| KR | 200408296 | 2/2006 |

OTHER PUBLICATIONS

The Supplementary European Search Report—Date of Completion Jul. 13, 2010.

* cited by examiner 211
264
262
220
222
254

32
264
262
222
220

221
220
264

58
64
32
62
20
72
54
56

30
31
64
32
62
22b
70
52
58
20
22a
69
60
56
11

14
64
20
21
69

120
122
162

162
194
190
192
120
122
52

121
120
194

20, 120, 220
72
40, 140, 240

CLEANING TOOL WITH FLUID DELIVERY DEVICE

BACKGROUND

Advancements continue to be made in cleaning tools adapted for dispense of fluid onto one or more surfaces prior to wiping, scrubbing, or other operation with such cleaning tools. Examples of such tools include mops and similar tools having fluid delivery devices. While such conventional tools are often suitable for their intended uses, further advancements in this technology are always welcome in the art.

SUMMARY

Some embodiments of this application are directed toward a fluid delivery device. More particularly, some embodiments are directed toward a fluid delivery system for a cleaning tool.

In one particular embodiment, the fluid delivery system includes a reservoir adapted to contain at least one fluid, a first conduit coupled to the reservoir and adapted to selectively dispense fluid from the reservoir, and a second conduit coupled to the reservoir and adapted to selectively dispense fluid from the reservoir, wherein an end of the second conduit is moveable relative to the first conduit to dispense fluid in a plurality of directions. When the fluid delivery system is coupled to the cleaning tool, the first conduit dispenses the fluid to a surface adjacent the cleaning head. The fluid delivery system further comprises a hand held dispensing head coupled to the moveable end of the second conduit. In some embodiments, the fluid delivery system further comprises a pump coupled to the reservoir adapted to pressurize the reservoir. Also, in some embodiments, the reservoir is divided into two chambers adapted to contain different fluids, wherein the first conduit is in fluid communication with a first chamber and the second conduit is in fluid communication with the second chamber.

Another embodiment is directed toward a cleaning tool having a handle, a cleaning head coupled to an end of the handle, and a fluid delivery system coupled to the handle. The fluid delivery system includes a reservoir adapted to contain at least one fluid, a first conduit coupled to the reservoir adapted to selectively dispense fluid from the reservoir, and a second conduit coupled to the reservoir adapted to selectively dispense fluid from the reservoir independent of the first conduit. The first conduit dispenses the fluid to a surface adjacent the cleaning head. A hand held dispensing head is coupled to an end of the second conduit. In some embodiments, the fluid delivery system further comprises a pump coupled to the reservoir adapted to pressurize the reservoir. Additionally, the reservoir can divided into two chambers adapted to contain different fluids, wherein the first conduit is in fluid communication with a first chamber and the second conduit is in fluid communication with the second chamber.

Some embodiments are also directed toward a cleaning tool having a fluid delivery system having a reservoir adapted to contain at least one fluid, a first outlet coupled to the reservoir adapted to selectively dispense fluid from the reservoir to a surface adjacent the cleaning head, and a second outlet coupled to the reservoir adapted to selectively dispense fluid from the reservoir independent of the first outlet. The fluid delivery system can further include a first conduit coupled to the first outlet, a second conduit coupled to the second outlet, and a hand held dispensing head coupled to the second outlet. In some embodiments, the fluid delivery system further comprises a pump coupled to the reservoir adapted to pressurize the reservoir. Also, in some embodiments, the reservoir is divided into two chambers adapted to contain different fluids, wherein the first conduit is in fluid communication with a first chamber and the second conduit is in fluid communication with the second chamber. In some embodiments, the reservoir is selectively separable from the handle for use independent of the cleaning tool.

DETAILED DESCRIPTION

Before any embodiments of the present invention are explained in detail, it is to be understood that the details of the construction as set forth in the following description and illustrated in the accompanying drawings are not intended as a limitation and do not define a limitation upon the scope of the present invention. The invention is capable of other embodiments and of being practiced or of being carried out in various ways. Also, it is to be understood that the phraseology and terminology used herein is for the purpose of description and should not be regarded as limiting.

Figure 1:
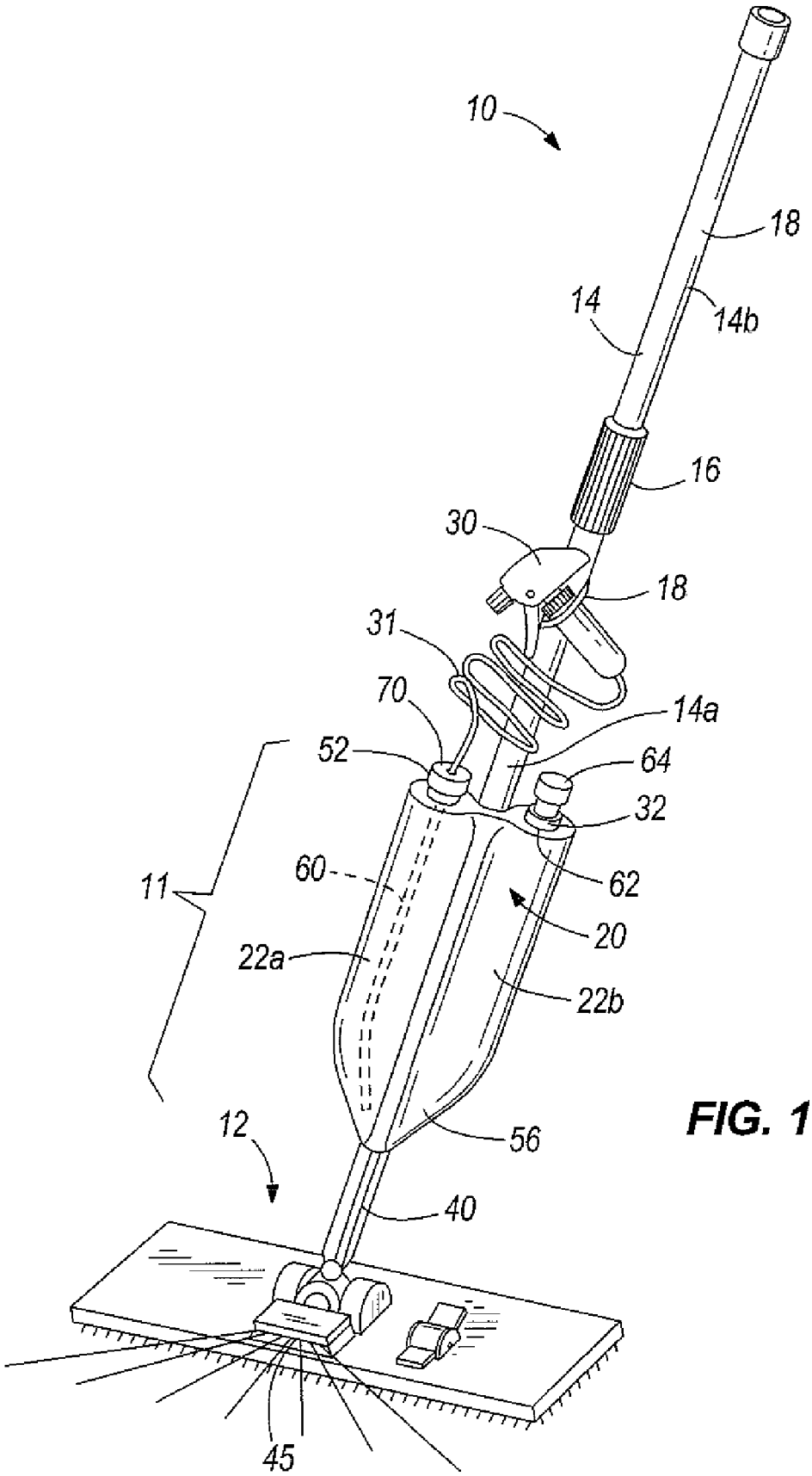
FIG. 1 is a perspective view of a cleaning tool with a fluid delivery device according to an embodiment of the present invention.

FIG. 1 illustrates a cleaning tool 10 with a fluid delivery device 11 according to an embodiment of the present invention. In the illustrated embodiment, the cleaning tool 10 is in the form of a mop or similar floor cleaning device. However, it should be noted that the fluid delivery device 11 can be utilized in conjunction with other types of cleaning tools, and that the illustrated form of a mop is presented by way of example only. For example, the present invention can be embodied in sponge mops, dust mops, wet mops, specialty mops, towel mops, brushes, squeegees, and a variety of other cleaning devices having handles.

The cleaning tool 10 illustrated in FIG. 1 includes a cleaning head 12 connected to the distal end of an elongated shaft 14. The cleaning head 12 can have one or more fluid nozzles 45 for delivery of fluid to locations adjacent the cleaning head 12. The size, location, and number of these nozzles 45 can vary depending upon the desired pattern of distribution and viscosity or other properties of fluids to be dispensed. The proximal end of the shaft 14 serves as a handle for mechanical manipulation of the cleaning head 12. In some embodiments, the shaft 14 is a single element, such as a tube or rod. In other embodiments, the shaft 14 comprises multiple elements connected together in any suitable manner, such as by one or more threaded connections, pin-and-aperture connections, and the like. Also, in some embodiments the shaft 14 can be adjustable, such as by telescoping inner and outer tubes 14*a*, 14*b*. For example, the inner and outer tubes 14*a*, 14*b* illustrated in FIG. 1 can be moved to a desired relative position with respect to one another (corresponding to a desired length of the shaft 14), after which time the inner and outer tubes 14*a*, 14*b* can be releasably secured against relative movement by rotation of a locking assembly 16 located on the shaft 14. This and other types of adjustable shafts can be employed in the present invention.

The fluid delivery device 11 of the illustrated embodiments in FIGS. 1-4*c* has a reservoir or bottle 20. The bottle 20 can have any shape desired. However, in some embodiments, the bottle 20 is substantially elongated and/or has a relatively flat shape. For example, the bottle 20 can have a relatively flat and elongated shape as shown in FIGS. 1-4*c*, thereby reducing interference of the bottle 20 in navigating obstructions about which the cleaning tool 10 is used (e.g., under beds, dressers, desks, and other furniture, and the like). The tapered bottom 56 of the bottle 20 can also reduce this interference, making the cleaning tool 10 easier to use. Additionally, the tapered shape can help funnel the solution contained within the bottle to a single location wherein the solution can be evacuated, dispensed, or otherwise removed from the bottle during use.

As shown in FIG. 1, the bottle 20 is connected to the shaft 14. This connection can be a permanent connection, such as by one or more rivets or other permanent fasteners, by adhesive or cohesive bonding material, by welding or brazing (depending at least in part upon the material of the shaft 14 and bottle 20), and the like. However, in other embodiments, the bottle 20 is detachable from the shaft 14. This feature can better facilitate cleaning and/or refill of the bottle 20, and in some embodiments can enable a user to detach the bottle 20 in order to use the bottle 20 (and other component(s) of the fluid delivery device 11 attached thereto) independently of the shaft 14 and cleaning head 12.

Figures 2A, 2B, 2C, 3A, 3B, 3C, 4A, 4B, 4C, 5:
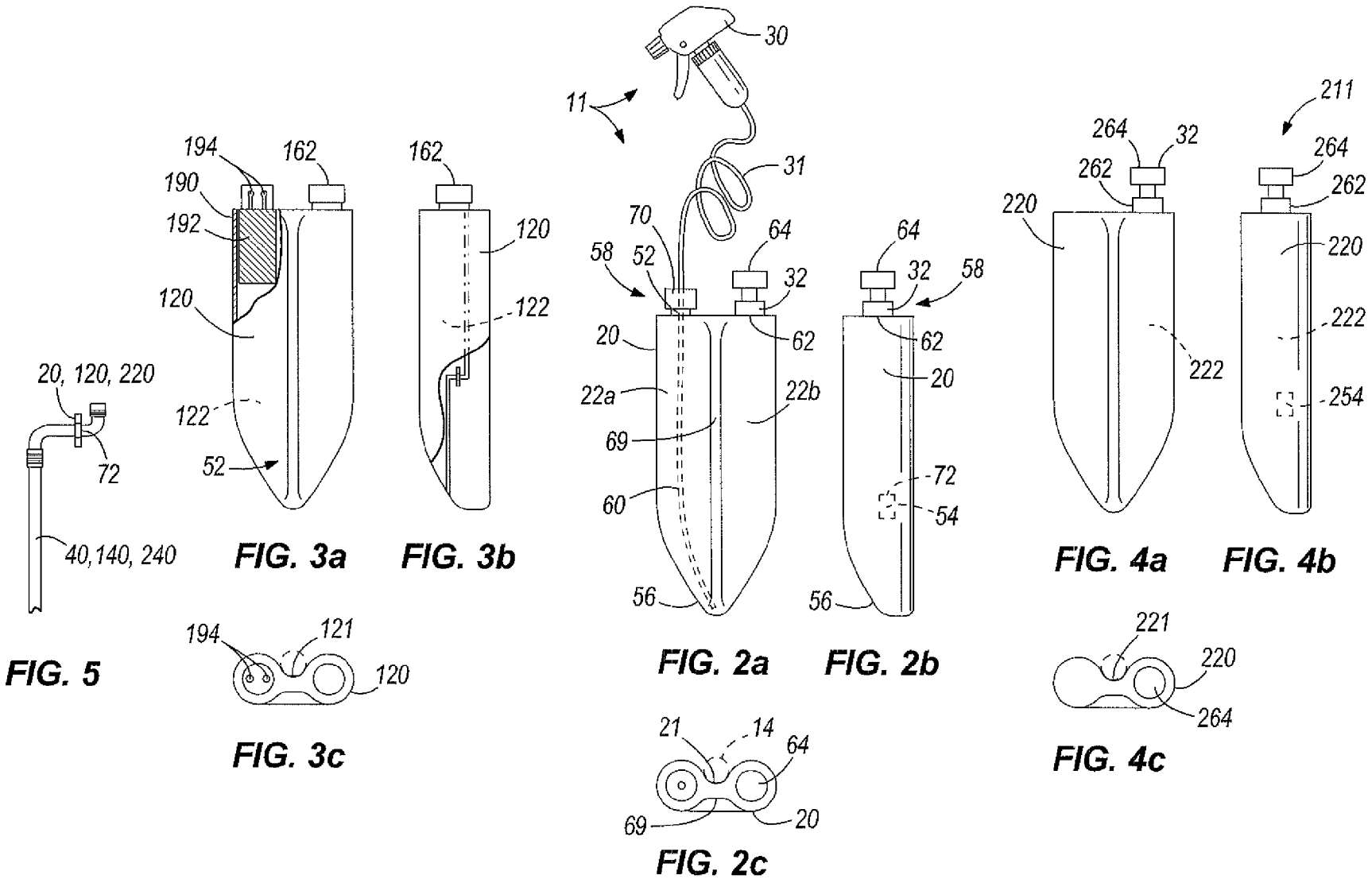
FIG. 2*a* is a front view of the fluid delivery device of the cleaning tool illustrated in FIG. 1.
FIG. 2*b* is a side view of the fluid delivery device illustrated in FIGS. 1 and 2*a*.
FIG. 2*c* is a top view of the fluid delivery device illustrated in FIGS. 1-2*b*.
FIG. 3*a* is a front view of a fluid delivery device according to another embodiment of the present invention, adapted for use with the cleaning tool illustrated in FIG. 1.
FIG. 3*b* is a side view of the fluid delivery device illustrated in FIG. 3*a*.
FIG. 3*c* is a top view of the fluid delivery device illustrated in FIGS. 3*a* and 3*b*.
FIG. 4*a* is a partially-sectioned front view of a fluid delivery device according to an yet another embodiment of the present invention, adapted for use with the cleaning tool illustrated in FIG. 1.
FIG. 4*b* is a partially-sectioned side view of the fluid delivery device illustrated in FIG. 4*a*.
FIG. 4*c* a is top view of the fluid delivery device illustrated in FIGS. 4*a* and 4*b*.
FIG. 5 is a detail view of a conduit connection for the fluid delivery devices illustrated in FIGS. 1-4*c*.

The bottle 20 can be releasably attached to the shaft 14 in a number of different manners, such as by one or more hooks, hangers, screws and other conventional fasteners, pin and aperture, dovetail, and other inter-engaging connections, hook and loop fastener material, a press-fit connection enabled by mating shapes of the bottle 20 and shaft 14, or in any other suitable manner. In some embodiments, the bottle 20 is releasably connected to the shaft 14 by receiving the shaft 14 into a groove 21 defined by the bottle 20. For example, in the illustrated embodiments of FIGS. 1-4*c*, the shaft 14 is shown as cylindrical and the bottle 20 is shaped to have a longitudinal groove 21, 121, 221 into which the shaft 14 can be pressed (as best shown in FIGS. 2*c*, 3*c*, and 4*c*). The diameter of the groove 21, 121, 221 can be slightly smaller than that of the shaft 14 such that an elastic connection is formed when the shaft 14 is pressed into the groove 21, 121, 221, thereby holding the bottle 20, 120, 220 in place. In these and other embodiments, the bottle 20, 120, 220 and/or the shaft 14 can be constructed of any material having sufficient elastic properties capable of accommodating the deformation required as the bottle 20, 120, 220 is pressed into place on the shaft 14. For example, the bottle 20, 120, 220 and shaft 14 in the illustrated embodiments comprise plastic.

The embodiment of the present invention illustrated in FIGS. 1-2*c* includes a dual fluid delivery device for cleaning solutions or other fluids contained within the bottle 20. The fluid delivery device 11 in the embodiment of FIGS. 1-2*c* is adapted to distribute fluid from the bottle 20 through either of two outlet ports 52, 54. The outlet ports 52, 54 can be located anywhere in the bottle 20 at which fluid can exit the bottle 20. For example, one of the outlet ports 54 in the bottle 20 illustrated in FIGS. 1-2*c* is located near the bottom 56 of the bottle 20, whereas the other outlet port 52 is located near a top 58 of the bottle 20. In either case, a conduit 60 (only one of which is shown in FIGS. 1 and 2*a*-*c*) can extend from either or both outlet ports 52, 54 to any location within the bottle 20 in order to draw fluid therefrom. In this manner, the outlet ports 52, 54 need not necessarily be located below the level of fluid within the bottle 20 in order for fluid to be dispensed from the bottle 20. For example, fluid can be drawn from the bottom 56 of the bottle 20 by a conduit 60 extending from an outlet port 54. The outlet ports 52, 54 can be provided with any type of permanent or releasable conduit fittings 70, 72 desired, including without limitation barbed tube fittings, fittings with one or more O-rings or other gaskets or seals, threaded fittings, swage fittings, John Guest® (trademark, John Guest International, Ltd.) fittings, and the like.

In some embodiments, the bottle 20 is provided with one or more removable or non-removable caps 32 for covering one or more additional ports 62. A removable cap 32 can be connected to the bottle 20 in any suitable manner, such as by a threaded fitting, any of the other types of fittings described above with reference to the outlet port fittings 70, 72 of FIGS. 1 and 2*a*-*c*, and the like. A removable cap 32 can enable a user to fill, empty, and/or clean the bottle 20. Like the outlet ports 52, 54, the cap 32 can be located anywhere on the bottle 20.

With continued reference to the embodiment of FIGS. 1 and 2*a*-*c*, the cap 32 can be part of a manual pump 64 connected to the bottle 20, regardless of whether the cap 32 is removable or non-removable. The manual pump 64 can take any conventional form, such as by telescoping internal and external parts in which a user reciprocates the internal part to force air into the bottle 20 via one or more one-way air valves in the manual pump 64. In this manner, a user can increase pressure within the bottle 20, thereby pressurizing fluid for delivery from the outlet ports 52 and/or 54 of the bottle 20. Any other type of manual pump 64 can be used, and falls within the spirit and scope of the present invention. In some embodiments, the manual pump 64 can be removed from the port 62 to enable a user to empty, fill, and/or clean the bottle 20.

The bottle 20 can have any number of internal chambers for holding the same or different types and/or amounts of fluid. For example, in some embodiments, the bottle 20 has a single internal chamber from which fluid is drawn out of either or both outlet ports 52, 54. However, in other embodiments, the bottle 20 can be shaped and/or can have one or more internal walls to define two or more internal chambers of the same or different sizes. For example, the bottle 20 illustrated in FIGS. 1 and 2*a*-*c* has two internal chambers 22*a*, 22*b* having substantially the same size and separated from one another by an internal wall 69. The internal wall 69 can be integral with the bottle 20 or can be a separate element connected inside the bottle 20. Also, the internal wall 69 can have any shape desired, defined at least in part by the shape of the bottle 20.

As mentioned above, the embodiment of the present invention illustrated in FIGS. 1 and 2*a*-*c* utilizes a dual fluid delivery device 11 having two outlet ports 52, 54 through which fluid in the bottle 20 can be dispensed. Each of the internal chambers 22*a*, 22*b* has an outlet port 52, 54 for this purpose, although either or both internal chambers 22*a*, 22*b* can have two or more outlet ports 52, 54 for dispense of fluid therethrough in other embodiments. Any type of fluid dispensing device can be connected to each of the outlet ports 52, 54. In the illustrated embodiment of FIGS. 1 and 2*a-c*, the outlet port 52 for one of the internal chambers 22*a* is fitted with a conduit 31 extending to a hand-held spray head 30, whereas the outlet port 54 for the other internal chamber 22*b* is fitted with a conduit 40 extending to the cleaning head 12 (see FIGS. 1 and 5). The conduits 31, 40 can take any suitable form, such as hose, tubing, pipe, and the like, and can extend to their respective outlet ports 52, 54 or further within the bottle 20, in which case the conduit 31 and/or 40 can define part or all of an internal conduit 60 as described above. Also, either or both conduits 31, 40 can be flexible or substantially rigid, and can be made of any suitable material, such as plastic, rubber, nylon, metal, and the like. For example, both conduits 31, 40 in the illustrated embodiment of FIGS. 1 and 2*a-c* are made of flexible plastic.

Although the bottle 20 illustrated in FIGS. 1 and 2*a-c* has two outlet ports 52,54 for delivery of fluid to a hand-held spray head 30 and a cleaning head 12 as described above, the two outlet ports 52, 54 can each be connected to any other fluid dispensing device of the same or different type. For example, the connections of the fluid dispensing devices 12, 30 to the outlet ports 52, 54 can be reversed, a hand-held spray head 30 can be connected to each outlet port 52, 54, or each outlet port 52, 54 can be connected and deliver fluid to the cleaning head 12. In short, each outlet port 52, 54 can be connected for fluid delivery to any type of fluid dispensing device desired, can deliver such fluid to the same fluid dispensing device or different fluid dispensing devices, and can deliver fluid to the same type of fluid dispensing device or different types of fluid dispensing devices. In some embodiments, the conduits 31, 40 can be disconnected and re-connected by a user to establish fluid communication with any one or more fluid dispensing devices of the cleaning tool 10, thereby enabling a user to modify the cleaning tool 10 as desired to suit his or her particular needs or the needs of a particular cleaning project.

As mentioned above, one of the internal chambers 22*b* of the bottle 20 illustrated in FIGS. 1-2*c* can be pressurized by a manual pump 64. In other embodiments, the internal chamber 22*b* is not provided with such a pump 64, in which cases fluid can be dispensed from the internal chamber 22*b* to the cleaning head 12 by gravity. Also, in other embodiments, the other internal chamber 22*a* can also or instead be provided with a manual pump (not shown) having any of the forms described above, thereby enabling a user to pressurize the internal chamber 22*a*. In such embodiments, the hand-held spray head 30 need not necessarily be of a type that draws fluid by internal pumping action of the spread head 30 (see FIGS. 1 and 2*a*), but can instead have a manually-operated valve that can be opened and closed by a user to dispense fluid from the pressurized internal chamber 22*a*. In the illustrated embodiment of FIGS. 1-2*c*, the hand-held spray head 30 can be hung from the shaft 14 by a hook 18 fixed to the shaft 14, or in any other suitable manner when not in use.

The bottle 20 can be provided with a single internal chamber in which is retained a single fluid (and in which a common internal pressure can be generated by a manual pump 64, if employed), or can have multiple internal chambers 22*a*, 22*b*, in which are retained multiple fluids of the same or different type (and in which the same or different pressures can be generated by one or more manual pumps, if employed). In any such embodiment, any of the internal chambers 22*a*, 22*b* can be provided with any number of outlet ports 52, 54 for delivering fluid to the same or different dispensing devices 12, 30 and/or to the same or different types of dispensing devices 12, 30.

A user can operate the cleaning tool 10 illustrated in FIGS. 1 and 2*a-c* by grasping and manipulating the shaft 14. The user can prepare the fluid delivery device 11 for fluid dispense by pumping the manual pump 64 until a desired pressure is reached within the internal chamber 22*b*. Thereafter, when the user desires to dispense cleaning fluid upon a surface adjacent the cleaning head 12, the user can operate a trigger (e.g., a button, lever, or other user-manipulatable device, not shown) connected to the conduit 40 leading from the bottle 20 to the cleaning head 12 in order to open the conduit 40. By opening the conduit 40, pressurized fluid is dispensed from the cleaning head 12 until the trigger is released or until pressure within the internal chamber 22*b* is sufficiently reduced. In those embodiments in which the internal chamber 22*b* is not provided with a manual pump 64 (or in some cases where the manual pump 64 has not been pumped), the trigger can be operated to open the conduit 40 for fluid dispense by gravity.

With continued reference to the embodiment of FIGS. 1 and 2*a-c*, the user can also grasp and squeeze the hand-held spray head 30 to dispense fluid from the other internal chamber 22*a* as desired, such as to spray cleaning fluid upon a countertop while holding the shaft 14, or to spray cleaning fluid while the fluid delivery device 11 is being carried independently (e.g., disconnected from) the shaft and cleaning head 12. To disconnect the fluid delivery device 11 from the rest of the cleaning tool 10, the user can disconnect the conduit 40 from the bottle 20 (in which case the conduit 40 and/or bottle 20 can be provided with a quick disconnect or other valve to prevent spillage), and can then pull the bottle 20 from the shaft 14. In those embodiments in which the internal chamber 22*a* for the hand-held spray head 30 is provided with a manual pump 64, the user can operate the manual pump 64 to develop pressure within the internal chamber 22*a* for pressurized fluid dispense from the hand-held spray head 30. It should be noted that the bottle 20 can be provided with a common manual pump 64 that can be used to pressurize two or more internal chambers 22*a*, 22*b* separated by one or more internal walls 69 described above.

A fluid delivery device according to another embodiment of the present invention is illustrated in FIGS. 3*a-c*, and shares many of the same features and elements described above with regard to the fluid delivery device 11 of FIGS. 1 and 2*a-c*. Accordingly, the following description focuses primarily upon those elements and features that are different from the embodiments described above. Reference should be made to the above description for additional information regarding the elements, features, and possible alternatives to the elements and features of the fluid delivery device illustrated in FIGS. 3*a-c* and described below. Elements and features of the embodiment shown in FIGS. 3*a-c* that correspond to elements and features of the embodiment of FIGS. 1 and 2*a-c* are designated hereinafter in the 100 series of reference numbers.

In the illustrated embodiment of FIGS. 3*a-c*, the bottle 120 has a single fluid reservoir 122 and a removable cap 162 enabling a user to fill, empty, and/or clean the bottle 120. In other embodiments, the cap 162 can be part of a manual pump, or can be part of a filling for connection of a conduit extending to a hand-held spray head or other fluid dispensing device.

The bottle 120 illustrated in FIGS. 3*a-c* is also provided with a receptacle 190 for receiving a fluid pump 192. The fluid pump 192 can be operated to pressurize the internal chamber 122 of the bottle 120, and can be powered by a re-chargeable or non-rechargeable battery (not shown, but part of the cross-hatched area of FIG. 3*a*). In the case of a re-chargeable battery, suitable electrical terminals 194 can be provided to enable a user to connect the battery to a power source for charging between uses of the cleaning tool.

The fluid pump 192 and battery can be in a single modular unit permanently or removably received within the receptacle 190. Alternatively, the fluid pump 192 can be housed separately from the battery, and can be connected thereto by any suitable electrical wiring, terminals, or other power connectors. In either case, the battery can be protected from exposure to fluid within the bottle 120 by being at least partially enclosed within a fluid-tight-receptacle 190. In other embodiments, the fluid pump 192 and/or battery can be located outside of the bottle 120, such as by being mounted on the outside of the bottle 120 and/or to the shaft 114, by being received within another receptacle of the bottle 120, and the like.

Fluid delivery devices according to other embodiments of the present invention can be provided with any number of powered fluid pumps 192, such as a single fluid pump for pressurizing one or more internal chambers 122, or two or more fluid pumps for pressurizing different respective internal chambers 122.

A fluid delivery device according to another embodiment of the present invention is illustrated in FIGS. 4*a-c*, and shares many of the same features and elements described above with regard to the fluid delivery device 11 of FIGS. 1 and 2*a-c*. Accordingly, the following description focuses primarily upon those elements and features that are different from the embodiments described above. Reference should be made to the above description for additional information regarding the elements, features, and possible alternatives to the elements and features of the fluid delivery device illustrated in FIGS. 4*a-c* and described below. Elements and features of the embodiment shown in FIGS. 4*a-c* that correspond to elements and features of the embodiment of FIGS. 1 and 2*a-c* are designated hereinafter in the 200 series of reference numbers.

In the illustrated embodiment of FIGS. 4*a-c*, the bottle 220 has a single fluid reservoir 222 and includes a manual pump 264 with a removable cap 262 enabling a user to fill, empty, and/or clean the bottle 220. The illustrated bottle 220 also has a single outlet port 254 for dispense of fluid through a conduit 240. The fluid delivery device 211 illustrated in FIGS. 4*a-c* provides another example of a bottle and outlet configuration that can be produced utilizing various features and elements described above in connection with FIGS. 1-3*c*.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

Various features of the invention are set forth in the following claims.

We claim:

1. A cleaning tool comprising:
a handle;
a cleaning head coupled to an end of the handle; and
a fluid delivery system coupled to the handle, the fluid delivery system comprising:
a reservoir divided into two chambers adapted to contain different fluids;
a first conduit coupled to the reservoir and adapted to selectively dispense fluid from the reservoir, the first conduit in fluid communication with a first chamber of the reservoir;
a second conduit coupled to the reservoir and adapted to selectively dispense fluid from the reservoir, the second conduit in fluid communication with a second chamber of the reservoir, wherein an end of the second conduit is moveable relative to the first conduit to dispense fluid in a plurality of directions;
and a hand held dispensing head coupled to the moveable end of the second conduit.

2. The cleaning tool of claim 1, wherein the first conduit dispenses the fluid to a surface adjacent the cleaning head.

3. The cleaning tool of claim 1, wherein the fluid delivery system further comprises a pump coupled to the reservoir adapted to pressurize the reservoir.

4. The cleaning tool of claim 1, wherein the second conduit selectively dispenses fluid independent of the first conduit.

5. The cleaning tool of claim 1, wherein the reservoir and second conduit are selectively functionally separable from the handle.

6. A cleaning tool comprising:
a handle;
a cleaning head coupled to an end of the handle; and
a fluid delivery system coupled to the handle, the fluid delivery system comprising:
a reservoir divided into two chambers adapted to contain different fluids;
a first conduit coupled to the reservoir and adapted to selectively dispense fluid from the reservoir, the first conduit in fluid communication with a first chamber of the reservoir;
a second conduit coupled to the reservoir and adapted to selectively dispense fluid from the reservoir independent of the first conduit, the second conduit in fluid communication with a second chamber of the reservoir; and
a hand held dispensing head coupled to an end of the second conduit.

7. The cleaning tool of claim 6, wherein the first conduit dispenses the fluid to a surface adjacent the cleaning head.

8. The cleaning tool of claim 6, wherein the fluid delivery system further comprises a pump coupled to the reservoir adapted to pressurize the reservoir.

9. A cleaning tool comprising:
a handle;
a cleaning head coupled to an end of the handle; and
a fluid delivery system coupled to the handle, the fluid delivery system comprising:
a reservoir divided into two chambers adapted to contain different fluids;
a first outlet coupled to the reservoir adapted to selectively dispense fluid from the reservoir to a surface adjacent the cleaning head;
a first conduit coupled to the first outlet and in fluid communication with a first chamber of the reservoir;
a second outlet coupled to the reservoir adapted to selectively dispense fluid from the reservoir independent of the first outlet;
a second conduit coupled to the second outlet and in fluid communication with a second chamber of the reservoir; and
a hand held dispensing head coupled to the second outlet.

10. The cleaning tool of claim 9, wherein the fluid delivery system further comprises a pump coupled to the reservoir adapted to pressurize the reservoir.

11. The cleaning tool of claim 9, wherein the reservoir is selectively functionally separable from the handle.

* * * * *